US009132622B2

(12) United States Patent
Ramakrishnan et al.

(10) Patent No.: US 9,132,622 B2
(45) Date of Patent: Sep. 15, 2015

(54) METHOD OF PRINTING UNIFORM LINE WIDTHS WITH ANGLE EFFECT

(71) Applicants: Ed S. Ramakrishnan, Spring, TX (US); Daniel Van Ostrand, Conroe, TX (US)

(72) Inventors: Ed S. Ramakrishnan, Spring, TX (US); Daniel Van Ostrand, Conroe, TX (US)

(73) Assignee: UNI-PIXEL DISPLAYS, INC., Santa Clara, CA (US)

( * ) Notice: Subject to any disclaimer, the term of this patent is extended or adjusted under 35 U.S.C. 154(b) by 21 days.

(21) Appl. No.: 13/784,699

(22) Filed: Mar. 4, 2013

(65) Prior Publication Data

US 2014/0245912 A1 Sep. 4, 2014

(51) Int. Cl.
*B41L 3/08* (2006.01)
*B41F 5/24* (2006.01)

(52) U.S. Cl.
CPC ..... *B41F 5/24* (2013.01)

(58) Field of Classification Search
CPC ..... B41F 5/24
USPC ..... 101/486
See application file for complete search history.

(56) References Cited

U.S. PATENT DOCUMENTS

| | | | | |
|---|---|---|---|---|
| 4,567,827 | A * | 2/1986 | Fadner | 101/352.11 |
| 5,017,223 | A * | 5/1991 | Kobayashi et al. | 106/31.13 |
| 5,701,815 | A | 12/1997 | Bocko et al. | |
| 6,213,018 | B1 * | 4/2001 | Samworth | 101/395 |
| 6,343,550 | B1 * | 2/2002 | Feesler | 101/376 |
| 7,807,001 | B2 * | 10/2010 | Zwadlo et al. | 156/64 |
| 8,384,691 | B2 | 2/2013 | Frey et al. | |
| 2002/0170451 | A1 | 11/2002 | Nakazawa et al. | |
| 2005/0016406 | A1 * | 1/2005 | Veismann | 101/486 |
| 2005/0217791 | A1 | 10/2005 | Costello et al. | |
| 2006/0021531 | A1 | 2/2006 | Schrauwers | |
| 2008/0055581 | A1 | 3/2008 | Rogers et al. | |
| 2009/0065776 | A1 | 3/2009 | Scher et al. | |
| 2009/0280305 | A1 * | 11/2009 | Ishikawa et al. | 428/201 |
| 2010/0021695 | A1 | 1/2010 | Naoyuki et al. | |
| 2010/0028815 | A1 * | 2/2010 | Zwadlo | 430/325 |
| 2010/0129620 | A1 * | 5/2010 | Lopez-Mas et al. | 428/201 |
| 2010/0282102 | A1 * | 11/2010 | Mehdizadeh | 101/363 |
| 2011/0185928 | A1 * | 8/2011 | Hendriks | 101/348 |
| 2012/0019591 | A1 | 1/2012 | Veis et al. | |

FOREIGN PATENT DOCUMENTS

| | | | |
|---|---|---|---|
| EP | 1295721 | A | 3/2003 |
| JP | 2011240604 | A * | 12/2011 |

OTHER PUBLICATIONS

International Search Report of the International Searching Authority (Korea) for corresponding international application PCT/US2013/065844 dated Jan. 24, 2014.

Written Opinion of the International Searching Authority (Korea) for corresponding international application PCT/US2013/065844 dated Jan. 24, 2014.

* cited by examiner

*Primary Examiner* — Anthony Nguyen
(74) *Attorney, Agent, or Firm* — Basil M. Angelo

(57) ABSTRACT

A method of printing uniform line widths with angle effect includes transferring ink to a flexo master comprising printing patterns disposed at an adjusted angle relative to a directional printing axis and transferring ink from the flexo master to a substrate. A flexographic printing system includes an ink roll, an anilox roll, a plate cylinder, a flexo master, and an impression cylinder. The flexo master is disposed on a plate cylinder. The flexo master includes printing patterns disposed at an adjusted angle relative to a directional printing axis.

24 Claims, 7 Drawing Sheets

METHOD OF PRINTING UNIFORM LINE WIDTHS WITH ANGLE EFFECT

BACKGROUND OF THE INVENTION

An electronic device with a touch screen allows a user to control the device by touch. The user may interact directly with the objects depicted on the display through touch or gestures. Touch screens are commonly found in consumer, commercial, and industrial devices including smartphones, tablets, laptop computers, desktop computers, monitors, gaming consoles, and televisions. A touch screen includes a touch sensor that includes a pattern of conductive lines disposed on a substrate.

Flexographic printing is a rotary relief printing process that transfers an image to a substrate. A flexographic printing process may be adapted for use in the fabrication of touch sensors. In addition, a flexographic printing process may be adapted for use in the fabrication of flexible and printed electronics ("FPE").

BRIEF SUMMARY OF THE INVENTION

According to one aspect of one or more embodiments of the present invention, a method of printing uniform line widths with angle effect includes transferring ink to a flexo master comprising printing patterns disposed at an adjusted angle relative to a directional printing axis and transferring ink from the flexo master to a substrate.

According to one aspect of one or more embodiments of the present invention, a flexographic printing system includes an ink roll, an anilox roll, a plate cylinder, a flexo master, and an impression cylinder. The flexo master is disposed on the plate cylinder. The flexo master includes printing patterns disposed at an adjusted angle relative to a directional printing axis.

Other aspects of the present invention will be apparent from the following description and claims.

DETAILED DESCRIPTION OF THE INVENTION

Figure 1:
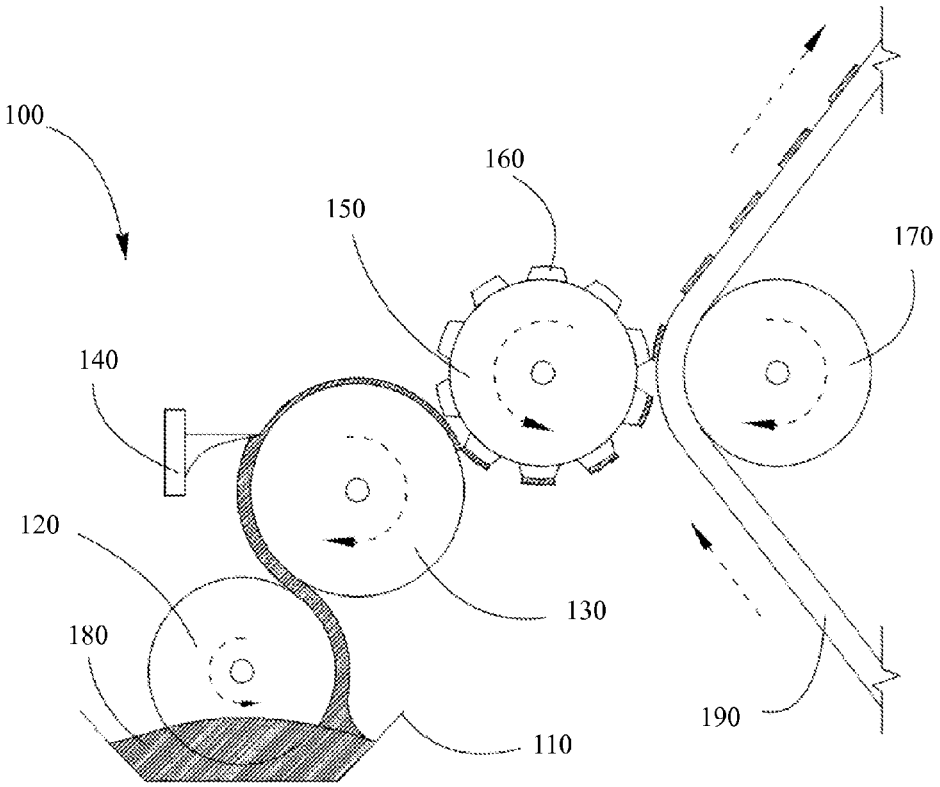
FIG. 1 PRIOR ART
FIG. 1 shows a side view of a conventional flexographic printing system.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

FIG. 1 shows a side view of a conventional flexographic printing system. A conventional flexographic printing system 100 includes an ink pan 110, an ink roll 120 (also referred to as a fountain roll), an anilox roll 130 (also referred to as a meter roll), a doctor blade 140, a printing plate cylinder 150, a flexo master 160, and an impression cylinder 170.

Ink roll 120 transfers ink 180 from ink pan 120 to anilox roll 130. Ink 180 may be any suitable combination of monomers, oligomers, polymers, metal elements, metal element complexes, or organometallics in a liquid state. Anilox roll 130 is typically constructed of a steel or aluminum core that may be coated by an industrial ceramic whose surface contains a plurality of very fine dimples, known as cells (not shown). Doctor blade 140 removes excess of ink 180 from anilox roll 130. Anilox roll 130 meters the amount of ink 180 transferred to printing plate cylinder 150 to a uniform thickness. Printing plate cylinder 150 may be generally made of metal and the surface may be plated with chromium, or the like, to provide increased abrasion resistance. Flexo master 160 covers printing plate 150. Flexo master 160 may be a rubber or photo-polymer that is elastomeric in nature. Flexo master 160 may be attached to printing plate 150 by an adhesive backing tape. A substrate 190 moves between the printing plate cylinder 150 and impression cylinder 170. Impression cylinder 170 applies pressure to printing plate cylinder 150, thereby transferring an image onto substrate 190. The rotational speed of printing plate cylinder 150 is synchronized to match the speed at which substrate 190 moves through the flexographic printing system 100. The speed may vary between 20 feet per minute to 2600 feet per minute.

Figure 2:
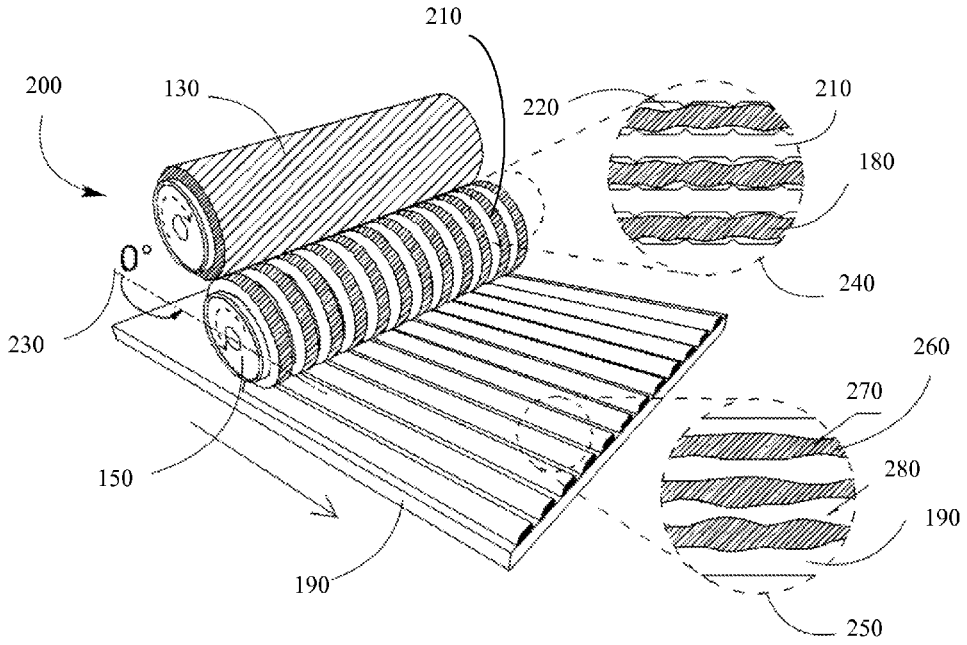
FIG. 2 PRIOR ART
FIG. 2 shows an isometric view of a portion of a conventional flexographic printing system configured for machine directional printing.

FIG. 2 shows an isometric view of a portion of a conventional flexographic printing system configured for machine directional printing. Flexographic printing system 200 includes an anilox roll 130 and printing plate cylinder 150. Flexo master 210 is disposed on printing plate cylinder 150. Flexo master 210 includes printing patterns 220. As flexo master 210 rotates, ink is transferred from printing patterns 220 to substrate 190 in a pattern corresponding to printing patterns 220. Printing patterns 220 of flexo master 210 are aligned with a zero degree angle 230 relative to a machine directional printing axis.

A close-up view 240 of a portion of flexo master 210 shows a close-up view of printing patterns 220. Anilox roll 130 may inefficiently transfer ink 180 to flexo master 210. The inefficient transfer of ink 180 from anilox roll 130 to flexo master 210 may be the result of pixel-to-pixel configuration of printing patterns 220 of flexo master 210 and/or the direct compression between printing patterns 220 and anilox roll 130. Additionally, the transfer of ink 180 from anilox roll 130 to flexo master 210 may exhibit waviness along printing patterns 220 of flexo master 210 when inked.

A close-up view 250 of a portion of substrate 190 shows a close-up view of a portion 260 of an image of printing patterns 220 transferred to substrate 190. Because of the non-uniform transfer of ink 180 to substrate 190, line width and line spacing along portion 260 on substrate 190 may be irregular. These irregular line width and line spacing variations negatively affect the line width 270 and line spacing 280. In addition, these irregular line width and line spacing variations negatively affect conductivity and performance and represent deviations from design parameters.

Figure 3:
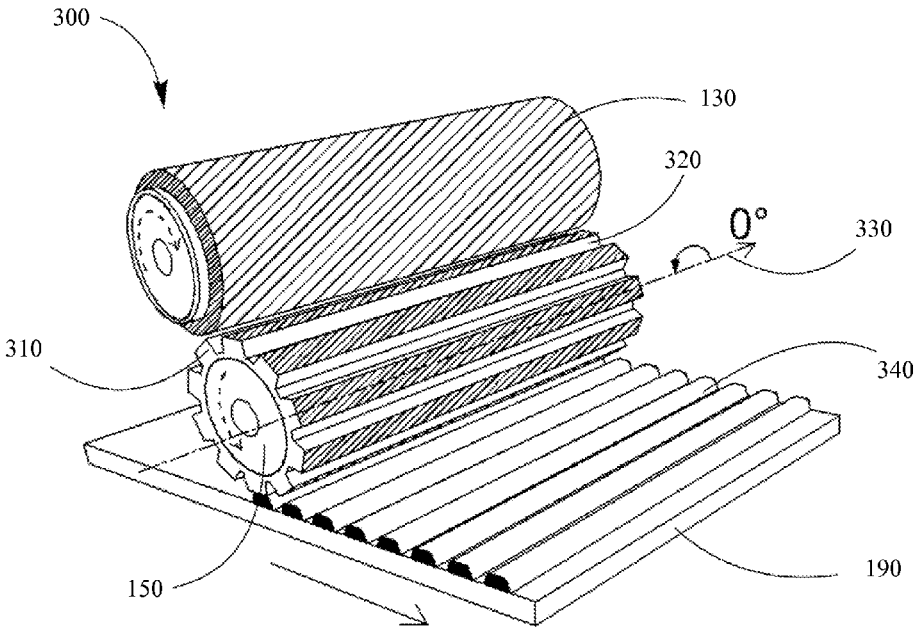
FIG. 3 PRIOR ART
FIG. 3 shows an isometric view of a conventional flexographic printing system configured for transverse directional printing.

FIG. 3 shows an isometric view of a portion of a conventional flexographic printing system configured for transverse directional printing. Flexographic printing system 300 includes an anilox roll 130 and printing plate cylinder 150. Flexo master 310 is disposed on printing plate cylinder 150. Flexo master 310 includes printing patterns 320. As flexo master 310 rotates, ink is transferred from printing patterns 320 to substrate 190 in a pattern corresponding to printing patterns 320. Printing patterns 320 of flexo master 310 are aligned with a zero degree angle 330 relative to a transverse directional printing axis. While flexographic printing system 300 operates in a substantially similar way to flexographic printing system 200 (of FIG. 2), in flexographic printing system 300, printing patterns 320 are aligned with a zero degree angle 330 relative to a transverse directional printing axis as compared to the machine directional printing axis of flexographic printing system 200. Printing in a transverse directional axis exhibits the same limitations relating to the non-uniform transfer of ink 180 from anilox roll 130 to flexo master 310 and the non-uniform transfer of ink 180 from flexo master 310 to substrate 190 as printing in a machine directional axis. Because of the non-uniform transfer of ink 180 to substrate 190, line width 340 and line spacing (not shown) on substrate 190 may be irregular. These irregular line width and line spacing variations negatively affect the line width (not shown) and line spacing (not shown). In addition, these irregular line width and line spacing variations affect conductivity and performance and represent deviations from design parameters.

As such, a substantial limitation of conventional flexographic printing systems is the non-uniform line width and line spacing exhibited by printed lines on substrate. The non-uniform line widths may be a consequence of pixel-to-pixel configuration of printing patterns on the flexo master. This pixel-to-pixel configuration on printing patterns may be formed during a laser abelation process, where this pixel-to-pixel configuration includes small squares aligned along the printing pattern. These small squares may exhibit an irregular shape with spaces missing between the joint of each small square. Consequently, ink transfer from anilox roll to printing patterns of the flexo master may be non-uniform. This non-uniformity may result in non-uniform line widths and line spacings when ink is transferred from the printing patterns to the substrate. This non-uniformity negatively affects the ability to print high resolution lines at a fine pitch.

In one or more embodiments of the present invention, a method of printing uniform line widths with angle effect and a flexographic system for printing uniform line widths with angle effect include a flexo master with printing patterns disposed at an adjusted angle relative to a directional printing axis.

Figure 4:
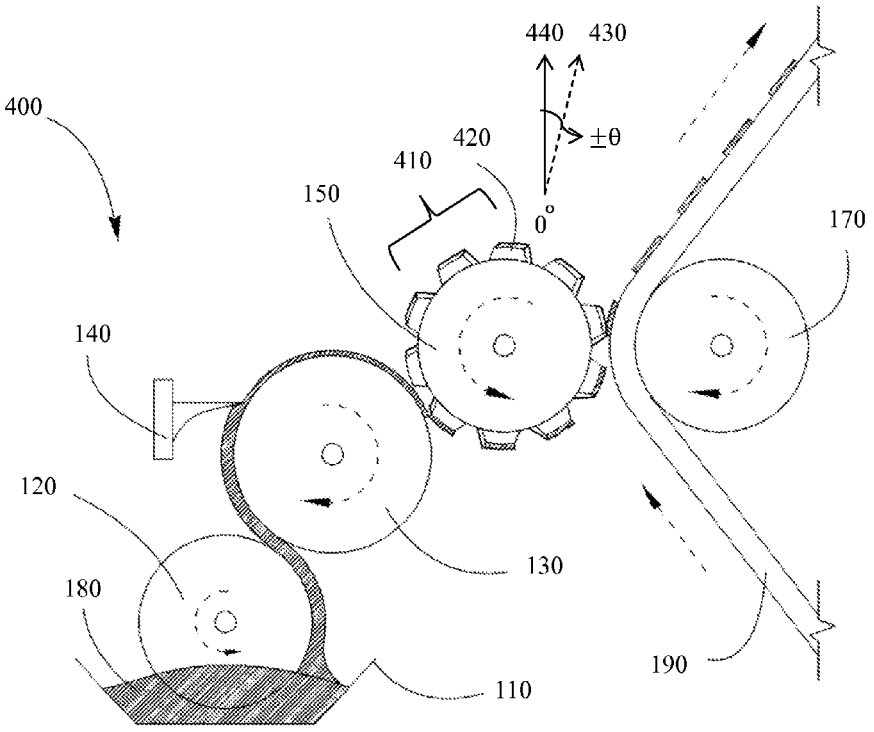
FIG. 4 shows a side view of a flexographic printing system for printing uniform line widths with angle effect in accordance with one or more embodiments of the present invention.

FIG. 4 shows a side view of a flexographic printing system for printing uniform line widths with angle effect in accordance with one or more embodiments of the present invention. In one or more embodiments of the present invention, flexographic printing system 400 includes an ink pan 110, an ink roll 120, an anilox roll 130, a doctor blade 140, a printing plate cylinder 150, a flexo master 410, and an impression cylinder 170.

Ink roll 120 transfers ink 180 from ink pan 110 to anilox roll 130. Anilox roll 130 may be constructed of a steel or aluminum core that may be coated by an industrial ceramic whose surface contains a plurality of very fine dimples, known as cells (not shown). Doctor blade 140 removes excess of ink 180 from anilox roll 130. Anilox roll 130 meters the amount of ink 180 transferred to printing plate cylinder 150 to a uniform thickness. Printing plate cylinder 150 may be made of metal and the surface may be plated with chromium, or the like, to provide increased abrasion resistance.

In one or more embodiments of the present invention, flexo master 410 covers printing plate cylinder 150. Flexo master 410 includes printing patterns 420 disposed at an adjusted angle 430 relative to a directional printing axis. In one or more embodiments of the present invention, flexographic printing system 400 may be configured for transverse directional printing. In one or more embodiments of the present invention, adjusted angle 430 may be approximately +15 degrees relative to transverse printing axis 440. In one or more embodiments of the present invention, adjusted angle 430 may be approximately −15 degrees relative to transverse printing axis 440. In one or more embodiments of the present invention, adjusted angle 430 may be approximately +25 degrees relative to transverse printing axis 440. In one or more embodiments of the present invention, adjusted angle 430 may be approximately −25 degrees relative to transverse printing axis 440. In one or more embodiments of the present invention, adjusted angle 430 may be in a range between approximately 15 degrees to approximately 30 degrees relative to transverse printing axis 440. In one or more embodiments of the present invention, adjusted angle 430 may be in a range between approximately −15 degrees to approximately −30 degrees relative to transverse printing axis 440.

In one or more embodiments of the present invention, flexographic printing system 400 may be configured for machine directional printing (not shown). In one or more embodiments of the present invention, adjusted angle 430 may be approximately +15 degrees relative to a machine printing axis (not shown). In one or more embodiments of the present invention, adjusted angle 430 may be approximately −15 degrees relative to a machine printing axis. In one or more embodiments of the present invention, adjusted angle 430 may be approximately +25 degrees relative to a machine printing axis. In one or more embodiments of the present invention, adjusted angle 430 may be approximately −25 degrees relative to a machine printing axis. In one or more embodiments of the present invention, adjusted angle 430 may be in a range between approximately 15 degrees to approximately 30 degrees relative to a machine printing axis. In one or more embodiments of the present invention, adjusted angle 430 may be in a range between approximately −15 degrees to approximately −30 degrees relative to a machine printing axis.

A substrate 190 moves between the printing plate cylinder 150 and impression cylinder 170. Impression cylinder 170 applies pressure to printing plate cylinder 150, thereby transferring an image, ink 180 disposed on flexo master 160, onto substrate 190. The rotational speed of printing plate cylinder 150 is synchronized to match the speed at which substrate 190 moves through the flexographic printing system 400. The speed may vary between 20 feet per minute to 2600 feet per minute.

In one or more embodiments of the present invention, substrate 190 may be transparent. In one or more embodiments of the present invention, transparent means the transmission of light with a transmittance rate of 90% or more. In one or more embodiments of the present invention, the substrate may be opaque. In one or more embodiments of the present invention, substrate 190 may be polyethylene terephthalate ("PET"). In one or more embodiments of the present invention, substrate 190 may be polyethylene naphthalate ("PEN"). In one or more embodiments of the present invention, substrate 190 may be high-density polyethylene ("HDPE"). In one or more embodiments of the present invention, substrate 190 may be linear low-density polyethylene ("LLDPE"). In one or more embodiments of the present invention, substrate 190 may be bi-axially-oriented polypropylene ("BOPP"). In one or more embodiments of the present invention, substrate 190 may be a polyester substrate. In one or more embodiments of the present invention, substrate 190 may be a polypropylene substrate. In one or more embodiments of the present invention, substrate 190 may be a thin glass substrate. One of ordinary skill in the art will recognize that other substrates are within the scope of one or more embodiments of the present invention.

The adjusted angle 430 of printing patterns 420 relative to a directional printing axis provides compression between printing patterns 420 and anilox roll 130. As such, ink 180 is transferred from anilox role 130 to printing patterns 420 in a more uniform and even distribution. In addition, ink 180 is transferred from printing patterns 420 to substrate 190 in a more uniform and even distribution. As such, fine lines with uniform line width and line spacing may be formed on substrate 190.

Figure 5:
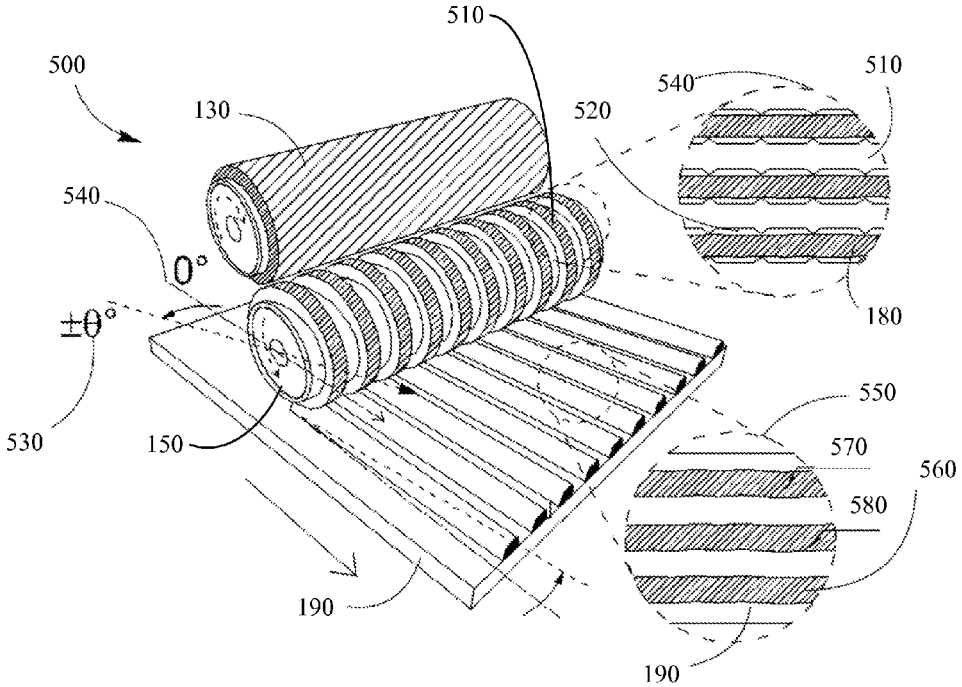
FIG. 5 shows an isometric view of a portion of a flexographic printing system for printing uniform line widths with angle effect configured for machine directional printing in accordance with one or more embodiments of the present invention.

FIG. 5 shows an isometric view of a flexographic printing system for printing uniform line widths with angle effect configured for machine directional printing in accordance with one or more embodiments of the present invention. Flexographic printing system 500 includes an ink pan 110 (not shown), an anilox roll 130, a printing plate cylinder 150, and an impression cylinder 170 (not shown). Flexo master 510 is disposed on printing plate cylinder 150. Flexo master 510 includes printing patterns 520 disposed at an adjusted angle 530 relative to machine printing axis 540. In one or more embodiments of the present invention, adjusted angle 530 may be approximately +15 degrees relative to machine printing axis 540. In one or more embodiments of the present invention, adjusted angle 530 may be approximately −15 degrees relative to machine printing axis 540. In one or more embodiments of the present invention, adjusted angle 530 may be approximately +25 degrees relative to machine printing axis 540. In one or more embodiments of the present invention, adjusted angle 530 may be approximately −25 degrees relative to machine printing axis 540. In one or more embodiments of the present invention, adjusted angle 530 may be in a range between approximately 15 degrees to approximately 30 degrees relative to machine printing axis 540. In one or more embodiments of the present invention, adjusted angle 530 may be in a range between approximately −5 degrees to approximately −30 degrees relative to machine printing axis 540.

As flexo master 510 rotates, ink is transferred from printing patterns 520 to substrate 190 in a pattern corresponding to printing patterns 520. A close-up view 540 of a portion of flexo master 510 shows a close-up view of printing patterns 520. The adjusted angle 530 of the printing patterns 520 relative to machine printing axis 540 provides compression between printing patterns 520 and anilox roll 130. As such, ink 180 is transferred from anilox role 130 to printing patterns 520 in a more uniform and even distribution. In addition, ink 180 is transferred from printing patterns 520 to substrate 190 in a more uniform and even distribution.

A close-up view 550 of a portion of substrate 190 shows a close-up view of a portion 560 of an image of printing patterns 520 transferred to substrate 190. The adjusted angle 530 of the printing patterns 520 relative to machine printing axis 540 provides compression between printing patterns 520 and anilox roll 130. As such, ink 180 is transferred from anilox role 130 to printing patterns 520 in a more uniform and even distribution. In addition, ink 180 is transferred from printing patterns 520 to substrate 190 in a more uniform and even distribution. Because of the uniform line width 570 and uniform line spacing 580, fine lines with uniform line width and uniform line spacing may be formed on substrate 190.

In one or more embodiments of the present invention, fine lines with a line width of approximately 1 micron can be achieved. In one or more embodiments of the present invention, fine lines with a line spacing of approximately 1 micron can be achieved. In one or more embodiments of the present invention, fine lines with a line width less than 10 microns can be achieved. In one or more embodiments of the present invention, fine lines with a line spacing less than 10 microns can be achieved. In one or more embodiments of the present invention, fine lines with a line width in a range between approximately 10 microns and approximately 50 microns can be achieved. In one or more embodiments of the present invention, fine lines with a line spacing in a range between approximately 10 microns and approximately 50 microns can be achieved. In one or more embodiments of the present invention, fine lines with a line width greater than 50 microns can be achieved. In one or more embodiments of the present invention, fine lines with a line spacing greater than 50 microns can be achieved.

Figure 6:
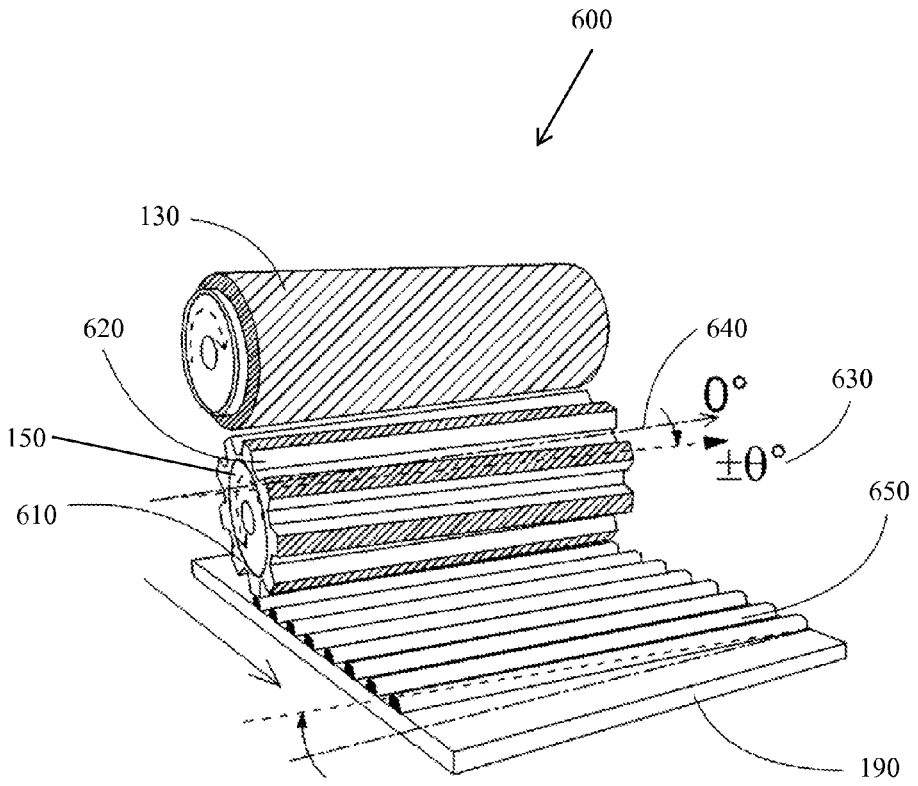
FIG. 6 shows an isometric view of a portion of a flexographic printing system for printing uniform line widths with angle effect configured for transverse directional printing in accordance with one or more embodiments of the present invention.

FIG. 6 shows an isometric view of a flexographic printing system for printing uniform line widths with angle effect configured for transverse directional printing in accordance with one or more embodiments of the present invention. Flexographic printing system 600 includes an ink pan 110 (not shown), an anilox roll 130, a printing plate cylinder 150, and an impression cylinder 170 (not shown). Flexo master 610 is disposed on printing plate cylinder 150. Flexo master 610 includes printing patterns 620 disposed at an adjusted angle 630 relative to transverse printing axis 640. In one or more embodiments of the present invention, adjusted angle 630 may be approximately +15 degrees relative to transverse printing axis 640. In one or more embodiments of the present invention, adjusted angle 630 may be approximately −15 degrees relative to transverse printing axis 640. In one or more embodiments of the present invention, adjusted angle 630 may be approximately +25 degrees relative to transverse printing axis 640. In one or more embodiments of the present invention, adjusted angle 630 may be approximately −25 degrees relative to transverse printing axis 640. In one or more embodiments of the present invention, adjusted angle 630 may be in a range between approximately 15 degrees to approximately 30 degrees relative to transverse printing axis 640. In one or more embodiments of the present invention, adjusted angle 630 may be in a range between approximately −15 degrees to approximately −30 degrees relative to transverse printing axis 640.

As flexo master 610 rotates, ink is transferred from printing patterns 620 to substrate 190 in a pattern corresponding to printing patterns 620. The adjusted angle 630 of the printing patterns 620 relative to transverse printing axis 640 provides compression between printing patterns 620 and anilox roll 130. As such, ink 180 is transferred from anilox role 130 to printing patterns 620 in a more uniform and even distribution. In addition, ink 180 is transferred from printing patterns 620 to substrate 190 in a more uniform and even distribution. Line widths 650 on substrate 190 are more uniform and evenly distributed. As such, fine lines with uniform line width and uniform line spacing may be formed on substrate 190.

In one or more embodiments of the present invention, fine lines with a line width of approximately 1 micron can be achieved. In one or more embodiments of the present invention, fine lines with a line spacing of approximately 1 micron can be achieved. In one or more embodiments of the present invention, fine lines with a line width less than 10 microns can be achieved. In one or more embodiments of the present invention, fine lines with a line spacing less than 10 microns can be achieved. In one or more embodiments of the present invention, fine lines with a line width in a range between approximately 10 microns and approximately 50 microns can be achieved. In one or more embodiments of the present invention, fine lines with a line spacing in a range between approximately 10 microns and approximately 50 microns can be achieved. In one or more embodiments of the present invention, fine lines with a line width greater than 50 microns can be achieved. In one or more embodiments of the present invention, fine lines with a line spacing greater than 50 microns can be achieved.

Figure 7:
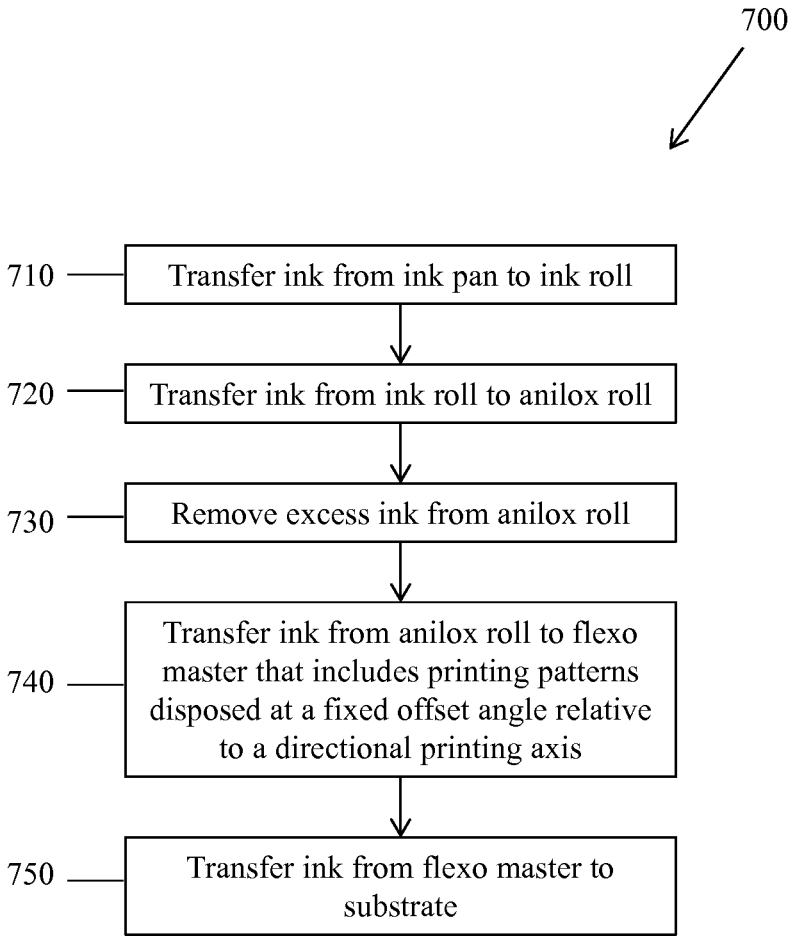
FIG. 7 shows a method of printing uniform line widths with angle effect in accordance with one or more embodiments of the present invention.

FIG. 7 shows a method of printing uniform line widths with angle effect in accordance with one or more embodiments of the present invention. In step 710, ink is transferred from an ink pan to an ink roll. In one or more embodiments of the present invention, the ink may be conductive and suitable for plating by an electroless plating process. In one or more embodiments of the present invention, the ink may be non-conductive. In step 720, ink is transferred from the ink roll to an anilox roll. In step 730, excess ink is removed from the anilox roll with a doctor blade.

In step 740, ink is transferred from the anilox roll to a flexo master that includes printing patterns disposed at an adjusted angle relative to a directional printing axis. In one or more embodiments of the present invention, the adjusted angle may be approximately +15 degrees relative to the directional printing axis. In one or more embodiments of the present invention, the adjusted angle may be approximately −15 degrees relative to the directional printing axis. In one or more embodiments of the present invention, the adjusted angle may be approximately +25 degrees relative to the directional printing axis. In one or more embodiments of the present invention, the adjusted angle may be approximately −25 degrees relative to the directional printing axis. In one or more embodiments of the present invention, the adjusted angle may be in a range between approximately 15 degrees to approximately 30 degrees relative to the directional printing axis. In one or more embodiments of the present invention, the adjusted angle may be in a range between approximately −15 degrees to approximately −30 degrees relative to the directional printing axis.

In one or more embodiments of the present invention, the directional printing axis may be a machine printing axis. In one or more embodiments of the present invention, the directional printing axis may be a transverse printing axis. The flexo master is disposed on a plate cylinder. In step 750, ink is transferred from the flexo master to a substrate. The substrate is movably disposed between the flexo master and an impression cylinder. The impression cylinder applies pressure to a point of contact between the flexo master and the substrate.

Advantages of one or more embodiments of the present invention may include one or more of the following:

In one or more embodiments of the present invention, a method of printing uniform line widths with angle effect enables printing of high resolution printed lines on a substrate.

In one or more embodiments of the present invention, a method of printing uniform line widths with angle effect minimizes line width variations on a substrate.

In one or more embodiments of the present invention, a method of printing uniform line widths with angle effect minimizes line spacing variations on a substrate.

In one or more embodiments of the present invention, a method of printing uniform line widths with angle effect produces uniform line widths on a substrate.

In one or more embodiments of the present invention, a method of printing uniform line widths with angle effect produces uniform line thickness on a substrate.

In one or more embodiments of the present invention, a method of printing uniform line widths with angle effect produces uniform pattern continuity on a substrate.

In one or more embodiments of the present invention, a method of printing uniform line widths with angle effect minimizes Moire interference effects between fine lines.

In one or more embodiments of the present invention, a method of printing uniform line widths with angle effect provides compression between an anilox roll and a printing pattern of a flexo master.

In one or more embodiments of the present invention, a method of printing uniform line widths with angle effect provides a uniform transfer of ink from an anilox roll to a printing pattern of a flexo master.

In one or more embodiments of the present invention, a method of printing uniform line widths with angle effect provides compression between a printing pattern of a flexo master and a substrate.

In one or more embodiments of the present invention, a method of printing uniform line widths with angle effect provides a uniform transfer of ink from a printing pattern of a flexo master to a substrate.

In one or more embodiments of the present invention, a method of printing uniform line widths with angle effect produces consistent resistance along a length of a conductor.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of printing uniform line widths with angle effect comprising:

transferring ink from an anilox roll to a flexo master comprising printing patterns disposed at an adjusted angle relative to a directional printing axis, wherein the adjusted angle is in a range between approximately 15 degrees and approximately 30 degrees; and transferring ink from the printing patterns to a transparent substrate, wherein the printing patterns comprise fine lines with a line width less than 10 microns, and wherein the ink comprises ink suitable for plating by electroless plating.

2. The method of claim 1, further comprising:

transferring ink from an ink pan to an ink roll;

transferring ink from the ink roll to the anilox roll; and removing excess ink from the anilox roll.

3. The method of claim 1, wherein the adjusted angle is approximately 15 degrees.

4. The method of claim 1, wherein the adjusted angle is approximately −15 degrees.

5. The method of claim 1, wherein the adjusted angle is approximately 25 degrees.

6. The method of claim 1, wherein the adjusted angle is approximately −25 degrees.

7. The method of claim 1, wherein the adjusted angle is in a range between approximately −15 degrees and approximately −30 degrees.

8. The method of claim 1, wherein the directional printing axis is a machine printing axis.

9. The method of claim 1, wherein the directional printing axis is a transverse printing axis.

10. The method of claim 1, wherein the printing patterns comprise lines with a line spacing less than approximately 10 microns.

11. The method of claim 1, wherein the printing patterns comprise lines with a width in a range between approximately 10 microns and approximately 50 microns.

12. The method of claim 1, wherein the printing patterns comprise lines with a line spacing in a range between approximately 10 microns and approximately 50 microns.

13. A flexographic printing system for printing on a transparent substrate comprising:

an ink roll;

an anilox roll;

a plate cylinder;

a flexo master disposed on the plate cylinder, wherein the flexo master comprises printing patterns disposed at an adjusted angle relative to a directional printing axis, wherein the adjusted angle is in a range between approximately 15 degrees and approximately 30 degrees; and an impression cylinder, wherein the printing patterns comprise fine lines with a line width less than 10 microns, and wherein the ink comprises ink suitable for plating by electroless plating.

14. The flexographic printing system of claim 13, further comprising:

an ink pan; and a doctor blade.

15. The flexographic printing system of claim 13, wherein the adjusted angle is approximately 15 degrees.

16. The flexographic printing system of claim 13, wherein the adjusted angle is approximately −15 degrees.

17. The flexographic printing system of claim 13, wherein the adjusted angle is approximately 25 degrees.

18. The flexographic printing system of claim 13, wherein the adjusted angle is approximately −25 degrees.

19. The flexographic printing system of claim 13, wherein the adjusted angle is in a range between approximately −15 degrees and approximately −30 degrees.

20. The flexographic printing system of claim 13, wherein the directional printing axis is a machine printing axis.

21. The flexographic printing system of claim 13, wherein the directional printing axis is a transverse printing axis.

22. The flexographic printing system of claim 13, wherein the printing patterns comprise lines with a line spacing less than approximately 10 microns.

23. The flexographic printing system of claim 13, wherein the printing patterns comprise lines with a width in a range between approximately 10 microns and approximately 50 microns.

24. The flexographic printing system of claim 13, wherein the printing patterns comprise lines with a line spacing in a range between approximately 10 microns and approximately 50 microns.

* * * * *